United States Patent [19]

Karp

[11] Patent Number: 4,558,256

[45] Date of Patent: Dec. 10, 1985

[54] VELOCITY TAPERING OF COMB-QUAD TRAVELING-WAVE TUBES

[75] Inventor: Arthur Karp, Palo Alto, Calif.

[73] Assignee: Varian Associates, Inc., Palo Alto, Calif.

[21] Appl. No.: 502,432

[22] Filed: Jun. 9, 1983

[51] Int. Cl.[4] ..... H01J 25/34

[52] U.S. Cl. ..... 315/3.5; 315/3.6

[58] Field of Search ..... 315/3.5, 3.6

[56] References Cited

U.S. PATENT DOCUMENTS

| | | | |
|---|---|---|---|
| 4,237,402 | 12/1980 | Karp | 315/3.6 |
| 4,315,194 | 2/1982 | Conolly | 315/3.6 |
| 4,481,444 | 11/1984 | Phillips | 315/3.6 |

*Primary Examiner*—Jerome Massie

*Attorney, Agent, or Firm*—Stanley Z. Cole; Richard B. Nelson; Peter J. Sgarbossa

[57] ABSTRACT

The "comb-quad" slow-wave interaction circuit for a traveling-wave tube consists of a pair of metallic ladders whose rungs cross, the rungs of one ladder passing through the spaces between the rung of the other ladder.

The phase velocity of the circuit wave is tapered to a lower value at the output end by gradually enlarging the axial open spaces between the longitudinal bases of the ladders and the surrounding envelope. The periodic elements of the ladders are all exactly alike, simplifying the construction.

The slowing of the wave velocity is greater at the lower-frequency end of the passband, providing improved efficiency over the operating band.

4 Claims, 7 Drawing Figures

2B
2C
2D
2E
30
35
12'
18'
26'
34
10'
14'
32
16'
36
34'

VELOCITY TAPERING OF COMB-QUAD TRAVELING-WAVE TUBES

FIELD OF THE INVENTION

The invention relates to traveling-wave tubes (TWTs) employing a slow-wave interaction circuit named the "comb-quad". This is basically two conductive ladders whose rung members are mutually interleaved and crossed.

PRIOR ART

The comb-quad circuit is described in U.S. Pat. No. 4,237,402 issued Dec. 2, 1980 to Arthur Karp and incorporated by reference into this application. This circuit will be described below as illustrated by FIG. 1 (essentially FIG. 5 of the referenced patent).

SUMMARY OF THE INVENTION

An object of the invention is to provide a slow-wave circuit of the comb-quad type in which the wave velocity is altered near one end.

A further object is to provide a circuit with tapered wave velocity yet in which the periodic elements are all alike.

A further object is to provide a circuit providing improved efficiency for the TWT it is in over a modest bandwidth.

These objects are achieved by progressively increasing the volume between the outer support members and the crossed ladders, as the output end of the circuit is approached.

DESCRIPTION OF THE PREFERRED EMBODIMENTS

Figure 1:
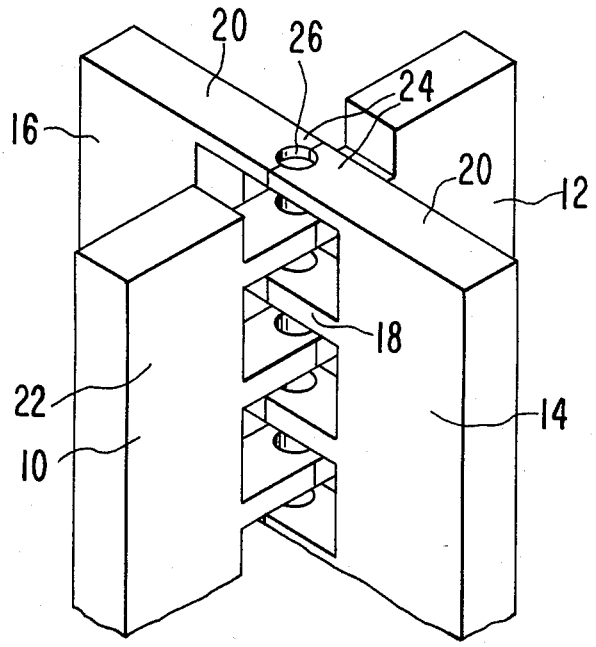
FIG. 1 PRIOR ART
FIG. 1 is a perspective view of the ladders of a comb-quad slow-wave circuit.

FIG. 1 illustrates the basic comb-quad slow-wave circuit described above as prior art. For clarity, the conductive envelope containing the illustrated ladders has been omitted. The surrounding envelope provides support, contains the rf field, acts as a heat sink and maintains the vacuum. Since the electromagnetic fields of the circuit extend out to this envelope, its internal shape affects the properties of the delay line, as will be shown below.

The internal circuit of FIG. 1 is formed from four comb-shaped, integral metal parts, as of OFHC copper, 10, 12, 14, 16. Each pair of combs 10, 12 and 14, 16 is positioned with the teeth 18 facing each other and axially aligned to form the electrical equivalent of a ladder 20, 22. Alternatively, the comb teeth may not meet, but form a gap between opposing teeth, which leaves the traveling-wave amplifying properties essentially unchanged. The two ladders 20, 22 have their rungs 24 crossed and mutually interleaved, the rungs 24 of one ladder passing through the openings of the other. Each rung 24 has a central hole 26 for passage of the electron beam. Holes 26 are all axially aligned and periodically spaced along the axis for periodic interaction of the beam with the electromagnetic circuit wave.

The comb-quad circuit has important advantages for high power at high frequencies. The symmetrical combs are machined from integral metal bars, so there are ultimately very few solder joints which must be crossed by the circulating rf currents; thus reduced circuit dissipation and less likelihood of perturbation of the electrical parameters by solder fillets. Also, heat flow is not interrupted by high-resistance joints. Most of the critical circuit dimensions and in particular the axial spacings are established by the machining of the ladders, so there is no accumulation of deviations to impair the precise periodicity of the many-period structures required for high frequencies.

In traveling-wave tubes it has long been known that efficiency can be raised by "tapering" the circuit. The phase velocity of the circuit wave is made gradually lower approaching the output end. Since the electron stream losess average velocity as it contributes energy to the growing circuit wave, tapering down the circuit velocity better maintains the required synchronism with the beam.

Various means of tapering the wave's phase velocity have been invented for the various kinds of slow-wave circuits. Generally the periodic length is decreased. This makes the circuit complex and hard to build—often individual parts must be made to a whole series of different critical dimensions.

Figures 2A, 2B, 2C, 2D:
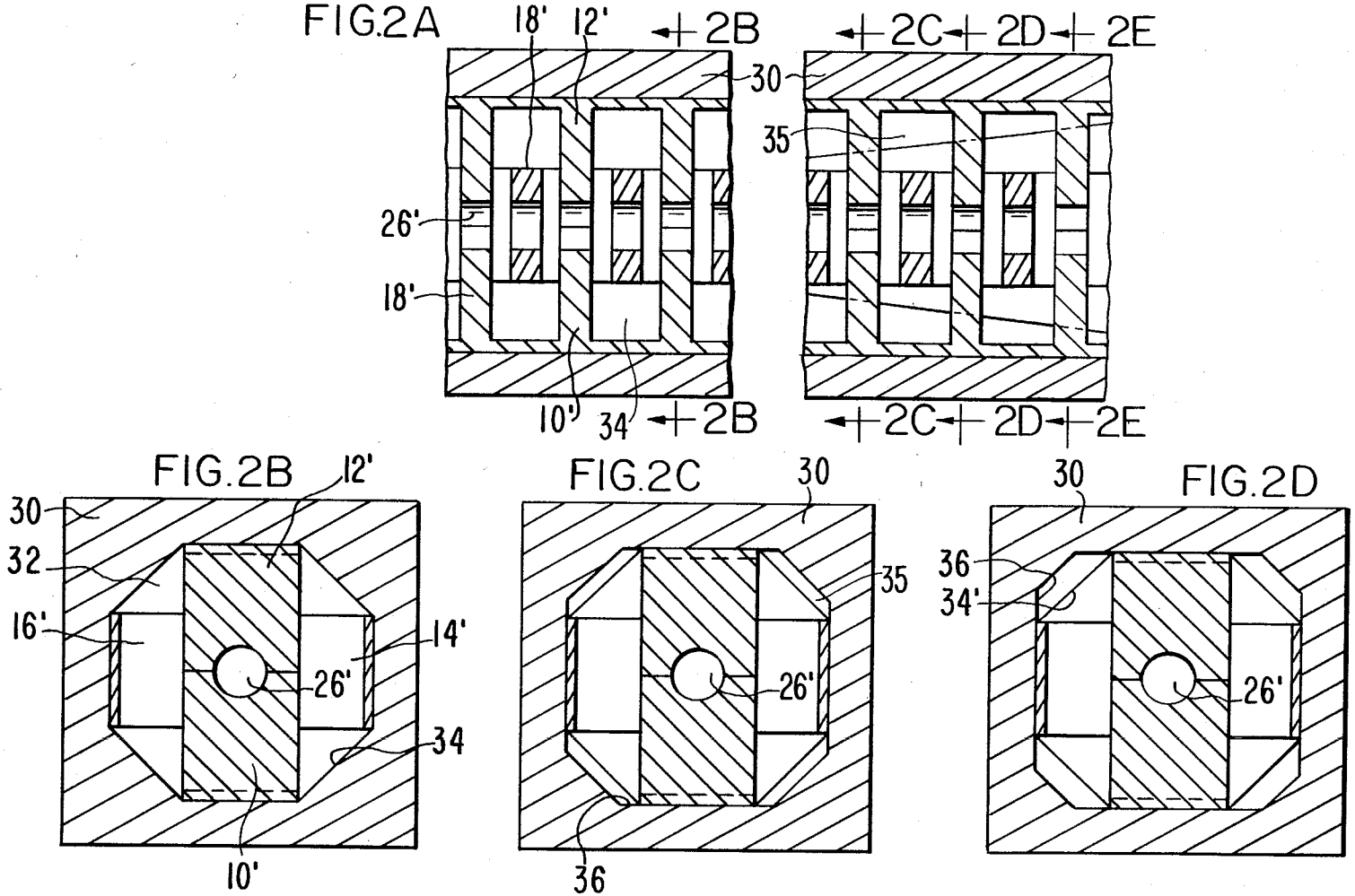
FIG. 2A is an axial section of a circuit embodying the invention.
FIGS. 2B, C, D and E are a series of transverse sectional views of the circuit of FIG. 2A.

The present invention for tapering the comb-quad circuit eliminates many difficulties. The periodic elements of the circuit all remain exactly alike, not varied along the length. FIGS. 2A–E illustrate the inventive structure. FIG. 2A is an axial section through the slow-wave circuit. This incorporates the circuit of FIG. 1 in an envelope 30, the main part of which has a cross section as shown in FIG. 2B. I have theoretically predicted and experimentally demonstrated that the phase velocity of the comb-quad circuit is a function of the size and shape of the four axial open spaces 32 between adjacent combs 10', 12' and 14', 16', and bounded by the inside 34 of the envelope 30.

Figure 2E:
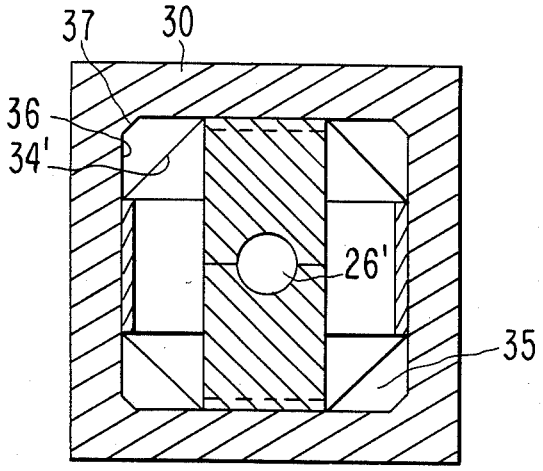

In general, the larger the cross section of these spaces 32, the slower the wave. Near the output end of the tube, according to the invention, spaces 32 are made progressively larger. In the embodiment illustratted, this is done by moving the diagonal wall 34 farther outward from the combs 10', 12', 14', 16', extending orthogonal walls 36 to a larger octagonal outline. FIG. 2C is a cross section midway through the tapering outward of diagonal walls 34. FIG. 2D is a cross section near the output end of the taper. FIG. 2E is a section at the end where the spaces extend out to the required limit 37.

The construction of FIGS. 2 is illustrated because it is easy to design and fabricate. However, an almost unlimited variety of geometries will produce the desired result. The invention covers all these and is intended to be limited only by the claims and their legal equivalents. The exact shape of the open spaces is not vital. The important factor is that these spaces are made progressively larger near the output end of the circuit. The shape need not be smoothly tapered as shown, but may be changed in one or more discrete jumps.

Figure 3:
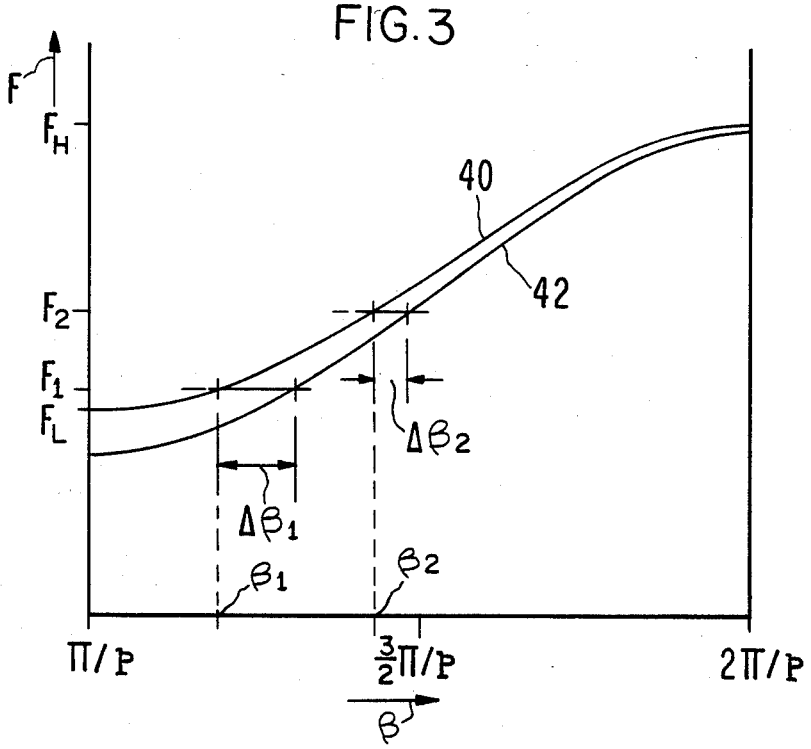
FIG. 3 is a dispersion diagram illustrating a favorable effect of the invention.

FIG. 3 is a dispersion diagram illustrating the effect of the inventive method of tapering and an additional benefit provided by this particular method. This kind of diagram is also known as a "Brillouin Diagram" or "omega-beta" diagram. The horizontal scale is the propagation constant beta; the vertical scale is the frequency, F. The axial. dimension p is the gap-to-gap periodic distance. The comb-quad circuit's phase velocity has a backward fundamental component, so the portion of the dispersion characteristic useful for wideband interaction with the fixed-velocity electron beam is centered around a phase shift per periodic length of about $3\pi/2$ radians. The total circuit bandwidth extends from the lower cutoff frequency $F_L$ where the phase shift per period is $\pi$ radians to the upper cutoff $F_H$ where the phase shift is $2\pi$. The phase shift of the untapered circuit for intermediate frequencies follows the smooth, somewhat sinusoidal curve 40. The useful TWT bandwidth is a frequency range $F_1$ to $F_2$ over which the curve 40 is relatively linear.

Curve 42 shows the effect of enlarging the axial open spaces 32. Curve 42 is below and steeper than curve 40. The phase velocity is the ratio of frequency to beta, so it is seen that this velocity is lowered by the larger spaces 32, as desired.

Another important consideration is the way the velocity is lowered across the operating band, $F_1$ to $F_2$. U.S. Pat. No. 3,846,664 issued Nov. 5, 1974 to R. King and W. Harris, describes optimum tapering by lowering the lower cutoff frequency $F_L$ only, keeping the upper cutoff $F_H$ constant. This produces the advantage of making the velocity change greater at lower frequency, thus equalizing the efficiency across the band. FIG. 3 show that the inventive scheme produces essentially that recommended effect. The percentage lowering of phase shift $\Delta\beta_1/\beta_1$ at the lower end of the band $F_1$ is greater than that $(\Delta\beta_2/\beta_2)$ at the upper end $F_2$.

A simplified explanation of this effect in the present invention is as follows: At the upper cutoff $F_H$ where $\beta=2\pi/p$, the electric fields in all the gaps are in phase (instantaneously in the same direction). These fields are produced by a standing wave at the resonance frequency of the cavity between adjacent crossed rungs of the two ladders. These axial fields are weak outside the area around the beam hole, so this resonance frequency $F_H$ is not much affected by the size or shape of the opening 32 between combs and supporting enclosure. At the lower cutoff $F_L$ the electric fields in successive gaps are reversed. This is produced by a standing-wave resonance in which all the rungs of one ladder are in phase with each other and all the rungs of the other ladder are in phase with each other but $\pi$ radians out of phase with the first set of rungs. The resonance thus occurs with large currents circulating around the intercomb openings 32, and with additional components of electric field, all in directions perpendicular to the circuit axis. Enlarging openings 32 increases the inductance affecting said currents and lowers the aforementioned resonance frequency considerably.

Any means of differentially lowering the lower cutoff frequency will provide the desired effect. The illustrated means of tapering the size of the side openings 32 is mechanically cheap and simple and permits leaving the periodic circuit elements all alike. The exact shape of openings 32 can follow a wide variety of forms. As described above, the size of the side openings may be increased with discrete jumps instead of smooth tapers.

What is claimed is:

1. A slow-wave circuit for a traveling-wave tube comprising:

a hollow conductive envelope extending around and along an axis;

two sets of equally spaced parallel identical rungs extending across said envelope, in angular separation, said rungs of a first set interleaving through the spaces between rungs of a second set;

an axial passageway through said rungs for a linear electron beam;

axially continuous openings bounded by the bases of rungs of said two sets and intervening walls of said envelope;

each of said sets of rungs comprising a pair of coplanar combs, each comb formed of a single piece of metal, each comb comprising an axial back member affixed to the inside of said envelope and an array of teeth extending toward said axis, the teeth of said combs of said set being axially aligned;

the cross section of at least one of said axially continuous openings being increased toward the output end of said circuit.

2. The circuit of claim 1 wherein each of said rungs comprises a pair of aligned teeth extending inward from said envelope toward said beam passageway but not touching each other.

3. The circuit of claim 1 wherein said cross section of said axially continuous opening is smoothly tapered toward said output end.

4. A slow-wave circuit for a traveling-wave tube comprising:

a hollow, conductive envelope extending along an axis, at least two sets of parallel rungs extending across said envelope, said rungs of a first set crossing said rungs of a second set, said rungs of said first set interleaving through the spaces between said rungs of said second set, said rungs all being of like dimensions, an axial passageway through said rungs for a linear electron beam, and axial openings bounded by the bases of rungs of said first set and rungs of said second set and said envelope, the cross section of at least one said axial opening being increased toward the output end of said circuit.

* * * * *